US007681933B2

(12) United States Patent
Chesness

(10) Patent No.: US 7,681,933 B2
(45) Date of Patent: Mar. 23, 2010

(54) SHOVEL WITH CROSSBAR HANDLE

(76) Inventor: Curtis J. Chesness, 981 140th La. NW., Andover, MN (US) 55304

( * ) Notice: Subject to any disclaimer, the term of this patent is extended or adjusted under 35 U.S.C. 154(b) by 0 days.

(21) Appl. No.: 12/015,562

(22) Filed: Jan. 17, 2008

(65) Prior Publication Data

US 2008/0315602 A1 Dec. 25, 2008

Related U.S. Application Data

(60) Provisional application No. 60/885,327, filed on Jan. 17, 2007.

(51) Int. Cl.
*E01H 5/02* (2006.01)

(52) U.S. Cl. ..... 294/54.5; 294/53.5; 294/57; 294/58

(58) Field of Classification Search ..... 294/54.5, 294/53.5, 57, 58; 37/265, 284, 285
See application file for complete search history.

(56) References Cited

U.S. PATENT DOCUMENTS

| | | | | | |
|---|---|---|---|---|---|
| 321,326 | A | * | 6/1885 | Waite | 294/54.5 |
| 389,092 | A | * | 9/1888 | Mercer | 37/284 |
| 2,388,985 | A | * | 11/1945 | Martin | 37/283 |
| 2,811,792 | A | * | 11/1957 | Cork, Jr. | 37/284 |
| 2,919,153 | A | * | 12/1959 | Benton | 294/51 |
| 2,967,363 | A | * | 1/1961 | Meier | 37/283 |
| 3,023,021 | A | * | 2/1962 | Fricke et al. | 280/47.34 |
| 3,024,547 | A | | 3/1962 | Harrison | |
| 3,154,336 | A | * | 10/1964 | Nelson | 37/265 |
| 3,380,772 | A | | 4/1968 | Lissakers | |
| 3,475,838 | A | * | 11/1969 | Hagen et al. | 37/265 |
| 3,583,746 | A | | 6/1971 | Lissakers | |
| 3,751,058 | A | | 8/1973 | Larsen | |
| 4,193,626 | A | * | 3/1980 | Vondracek | 37/265 |
| 4,248,466 | A | | 2/1981 | Carper | |
| D261,351 | S | | 10/1981 | Carper | |
| D271,369 | S | | 11/1983 | Gesner | |
| 4,669,206 | A | * | 6/1987 | Yost | 37/285 |
| D305,603 | S | | 1/1990 | Nelson et al. | |
| D333,074 | S | | 2/1993 | Ciccarelli | |
| D361,482 | S | | 8/1995 | Fugal | |
| D375,235 | S | | 11/1996 | Spear et al. | |
| D375,882 | S | | 11/1996 | Ritchie et al. | |

(Continued)

OTHER PUBLICATIONS

QVC, Inc., Item No. M7236 Lightweight Ergonomic Snow Shovel with Wheels, Apr. 25, 2005, URL: http://www.qvc.com.

(Continued)

*Primary Examiner*—Dean J Kramer
(74) *Attorney, Agent, or Firm*—Dorsey & Whitney LLP; Brett A. Klein, Esq.

(57) ABSTRACT

Disclosed herein is a shovel. The shovel may include a handle and a pivotable bracket for securing the handle to the shovel blade. The handle may include a horizontal crossbar grip portion and two vertical grip portions generally perpendicular to at least one of the crossbar grip portion and a longitudinally extending portion of the handle extending to a blade of the shovel. The shovel is suitable for moving and removing a variety of materials, including snow.

20 Claims, 9 Drawing Sheets

U.S. PATENT DOCUMENTS

| | | | | | |
|---|---|---|---|---|---|
| 5,577,786 | A | * | 11/1996 | Laine | 294/54.5 |
| D378,890 | S | | 4/1997 | Furno | |
| D392,522 | S | | 3/1998 | Kenyon | |
| D405,665 | S | | 2/1999 | Whitehead et al. | |
| 5,887,919 | A | | 3/1999 | Sallinen et al. | |
| D409,885 | S | | 5/1999 | McKenzie | |
| 6,053,548 | A | * | 4/2000 | Bowles, Jr. | 294/54.5 |
| D475,257 | S | | 6/2003 | Somers | |
| D563,182 | S | | 3/2008 | Kopp | |
| D564,846 | S | | 3/2008 | Kopp | |
| D586,192 | S | | 2/2009 | Chesness | |

OTHER PUBLICATIONS

Aubuchon Hardware, Snow Pusher & Plow Extra Wide, 36", Apr. 25, 2005, URL: http://lawn-and-garden.hardwarestore.com.

Always Something Brilliant, No-Lift Snow Shovel, Apr. 25, 2005, URL: http://alwaysbrilliant.com.

Shopping.com, Back-Saving Rolling Snow Shovel, Apr. 25, 2005, URL: http://www2.shopping.com.

Shopping.com, EZ Rolling Shovel, Apr. 25, 2005, URL: http://www2.shopping.com.

Shopping.com, Rolling Snowplow at Harriet Carter, Apr. 25, 2005, URL: http://www2.shopping.com.

* cited by examiner

SHOVEL WITH CROSSBAR HANDLE

CROSS-REFERENCE TO RELATED APPLICATIONS

The present application claims the benefit under 35 U.S.C. §119(e) to U.S. Provisional Patent Application No. 60/885,327 ("the '327 application"), which was filed on Jan. 17, 2007, and entitled "Shovel with Crossbar Handle." The present application is also related to U.S. Design Application Ser. No. 29/302,506, filed Jan. 17, 2008, and entitled "Shovel with Crossbar Handle," now Design U.S. Pat. No. D586,192, issued Feb. 10, 2009. The '327 application and the above-mentioned design application are incorporated by reference into the present application in their entirety.

FIELD OF THE INVENTION

The present invention relates to shovels and methods of shoveling. More particularly, the present invention relates to shovel handles and methods of griping a shovel handle.

BACKGROUND

Shoveling snow from a surface (e.g., a sidewalk, driveway, patio, etc.) can be strenuous and result in injury to a person's wrists, elbows, shoulders and back. There is a need in the art for an ergonomic shovel handle that eases the effort associated with shoveling and reduces the likelihood of injury.

SUMMARY OF THE INVENTION

Disclosed herein is a shovel. The shovel may include a handle and a pivotable bracket for securing the handle to the shovel blade. The handle may include a horizontal crossbar grip portion and two vertical grip portions generally perpendicular to at least one of the crossbar grip portion and a longitudinally extending portion of the handle extending to a blade of the shovel. The shovel is suitable for moving and removing a variety of materials, including snow.

Disclosed herein is a shovel. The shovel may include a blade and a handle extending from the blade. The handle may include a pair of shafts, a horizontal member and a pair of vertical members. A bottom end of each shaft may be operably coupled to the blade and an upper end of each shaft may be operably coupled to and nearly perpendicular with a respective vertical member. The horizontal member may include first and second ends and each end of the horizontal member may be operably coupled to and nearly perpendicular with a respective vertical member.

Disclosed herein is a shovel. The shovel may include a blade and a handle. The handle may include a horizontal grip portion, a first vertical grip portion operably coupled to and generally perpendicular with a first end of the horizontal grip portion, a second vertical grip portion operably coupled to and generally perpendicular with a second end of the horizontal grip portion, a first shaft extending from the blade to operably couple to the first vertical grip portion in a generally perpendicular manner, and a second shaft extending from the blade to operably couple to the second vertical grip portion in a generally perpendicular.

Disclosed herein is a shovel. The shovel may include a blade and a handle. The handle may include a shaft portion and a grip portion. The shaft portion may couple the grip portion to the blade. The grip portion may include a horizontal grip and a vertical grip near each end of the horizontal grip.

The length of the horizontal grip may be between approximately 25% to approximately 75% of the length of the shaft portion.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DESCRIPTION OF THE INVENTION

Crossbar Handle

Figure 2:
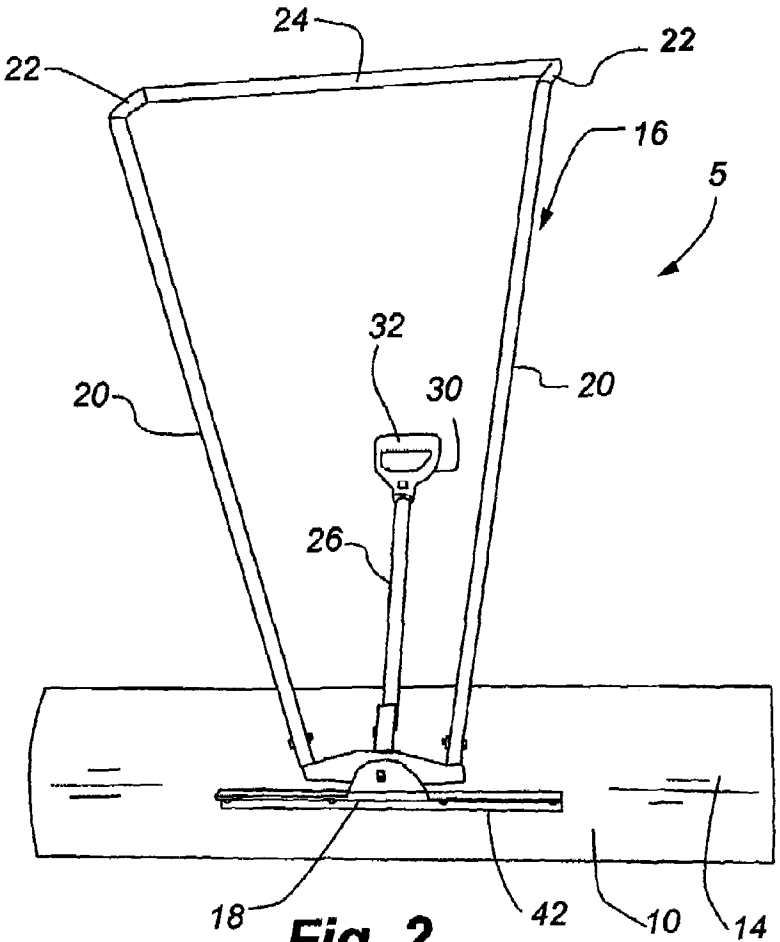
FIG. 2 is a rear view of the shovel of FIG. 1.

In one embodiment, shown in FIGS. 1-4, the shovel 5 comprises a blade 10 having a concave front surface 12 and a convex rear surface 14. Blade 10 may be formed of a plastic or other known durable and strong material. A handle 16 is secured to rear surface 14 with bracket 18, which is mounted on blade 10. Handle 16 generally comprises two shaft members 20 that are secured to bracket 18, two extension members 22 that protrude from the shaft members creating approximately a right-angle therewith, and a crossbar 24 that extends across the two extension members 22 and functions as a grip. Thus, in some embodiments, the handle 16 may be described as being a crossbar grip handle 16 or to have a crossbar grip 24.

Figure 1:
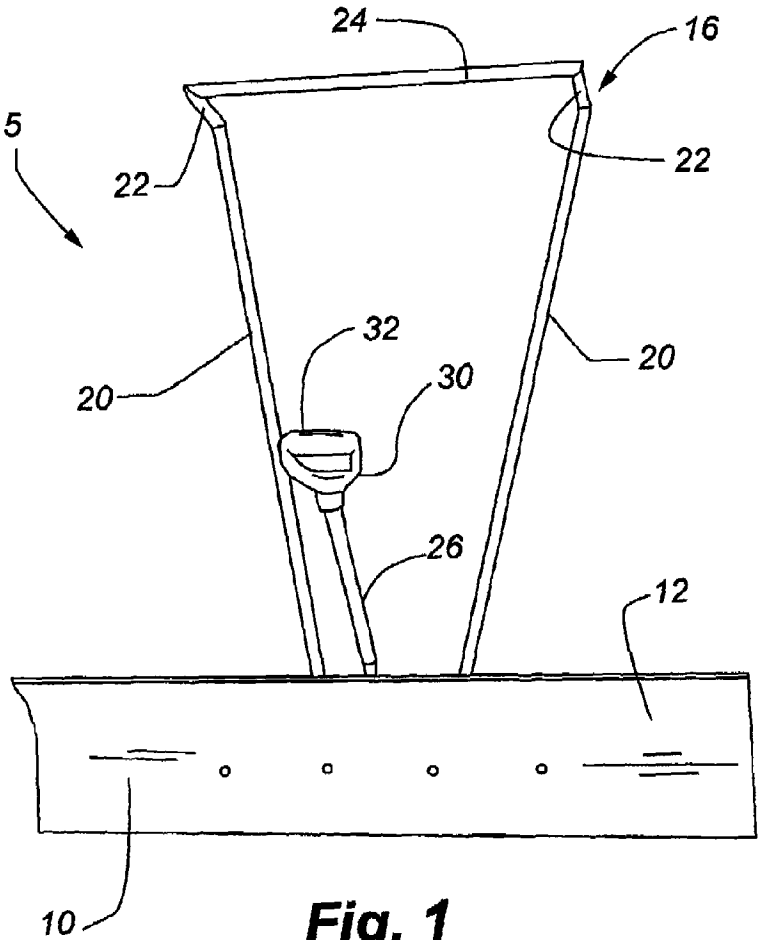
FIG. 1 is a front view of a shovel in accordance with one embodiment of the present invention.
Figure 3:
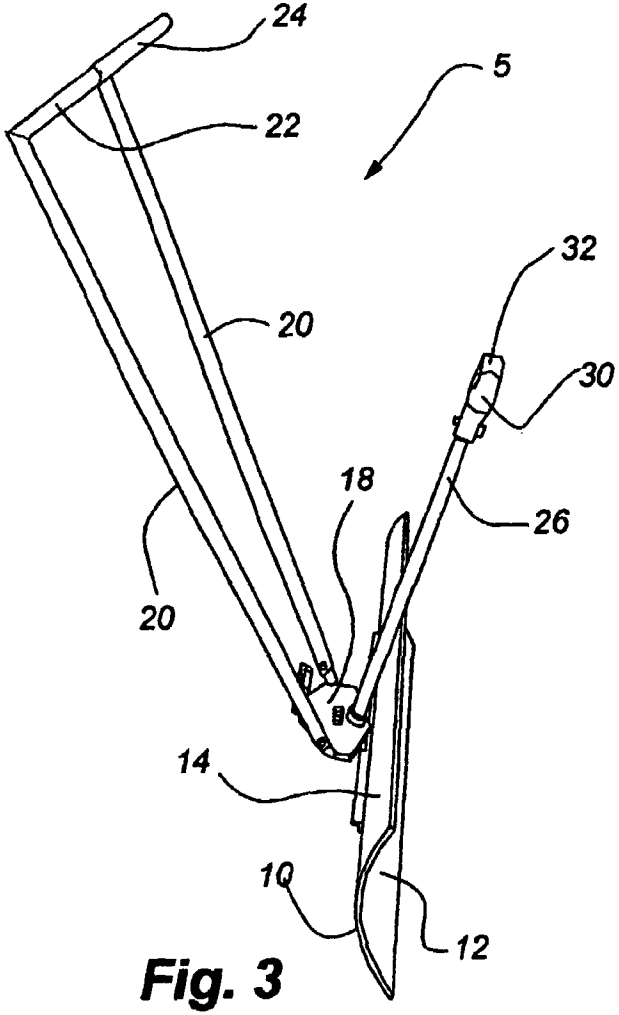
FIG. 3 is a side view of the shovel of FIG. 1.

In one embodiment, as shown in FIGS. 1 and 2, the two shaft members 20 extend away from each other, thereby creating a V-shape. The various components of the handle 16 may be welded together, as shown in FIGS. 1-4. Alternatively, the handle 16 may be milled of a single tube, which provides for smooth angles in the handle. The length of extension members 22 defines the distance between crossbar grip 24 and the upper end of shaft members 20, as shown in FIG. 3. By adjusting the length of the extension members and the shaft members 20, an appropriate angle between shaft members 20 and the shoveling surface and an appropriate height of the crossbar grip 24 may be achieved.

Crossbar grip member 24 provides a wide surface for gripping during operation of the shovel. The crossbar grip is suitable for a user of the shovel 5 to grasp with two hands, thereby allowing the user to exert his or her available force on the shovel; as the user exerts force on the crossbar grip handle 16, the force is transferred from the handle to the bracket 18, and from the bracket to the blade 10. The wide crossbar grip 24 also allows the user to easily and readily exert the desired force towards the left or right side of the shovel blade 10 as appropriate by exerting force on the corresponding side of the crossbar grip. This is may be useful when the terrain or material being shoveled is not completely uniform, thereby requiring the user to adjust accordingly and apply more pressure towards the left side of the shovel than the right side, or visa versa.

In one embodiment, the extension members or vertical grip members 22 may be nearly or generally perpendicular with the crossbar 24 and the shaft members 20 such that when the edge of the shovel blade 10 is properly engaged with a surface (e.g., sidewalk, patio, driveway, etc.) for shoveling, the crossbar or horizontal grip 24 will be generally horizontal and the extension or vertical members 22 will be oriented generally vertical. The extension members 22 may couple the crossbar 24 to the shaft members 20.

The configuration of the handle 16 allows the user to ergonomically grip the handle 16 when pushing or otherwise moving snow or other debris with the shovel 5. For example, the user has the option of using a vertical grip or a horizontal grip, both of which are much more ergonomic than the grips used with standard shovel handles know in the art. When using a vertical grip, the user may grasp the vertical extension members 22 with his arms bent at the elbow, his forearms extending forwardly generally parallel to each other, and his hands gripping the vertical grips 22 such that his thumbs would point upward were they fully extended. Such a two-handed grip is quite natural for the user and allows the user to exert maximum force and control on the shovel 5 with minimal stress on the shoulders, elbows, wrists and back. For some individuals with tendonitis or other chronic pain in the wrists, forearms and elbows, such a vertically oriented grip made possible via the vertical extension members 22 allows the user to shovel snow with the least amount of tension or twist in the forearm and, as a result, the least amount of discomfort.

When using a horizontal grip, the user may grasp the horizontal crossbar member 24 with his arms bent at the elbow, his forearms extending forwardly generally parallel to each other, and his hands gripping the horizontal grip 24 such that his thumbs would point towards each other along the horizontal grip 24 were they fully extended. Such a two-handed grip is quite natural for the user and allows the user to exert maximum force and control on the shovel 5 with minimal stress on the shoulders, elbows, wrists and back.

In one embodiment, the configuration of the handle 16 helps to create a moment about the intersection of the vertical member 22 with the shafts 20 when the user pushes the shovel 5 forward when grasping the vertical grips 22 or the horizontal grip 24. The resulting moment causes the edge of the blade 10 to push downward against the surface being shoveled, increasing the ability of the shovel blade 10 to scrape snow or other debris away from the surface (e.g., sidewalk, driveway, patio, etc.).

In one embodiment, the shaft members 20 will diverge as they extend from the back of the blade 10 to the vertical members 22. In other embodiments, the shaft members will be approximately parallel as they extend from the back of the blade 10 to the vertical members 22.

In one embodiment, each shaft member 20 and the vertical member 22 connected thereto will be generally or nearly perpendicular to each other. In other words, as can be understood from FIG. 4, depending on the embodiment, the angle A formed between each shaft member 20 and the vertical member 22 connected thereto will be between approximately 70 degrees and approximately 110 degrees, between approximately 75 degrees and approximately 105 degrees, between approximately 90 degrees and approximately 105 degrees, or approximately 103 degrees.

In one embodiment, the length of each shaft 20 is between approximately 30 inches and approximately 54 inches, the length of each vertical member 22 is between approximately 4 inches and approximately 10 inches, and the length of the horizontal member 24 is between approximately 21 inches and approximately 33 inches. In a preferred embodiment, the length of each shaft 20 is approximately 42 inches, the length of each vertical member 22 is approximately 6 inches, and the length of the horizontal member 24 is approximately 27 inches. The length of the horizontal grip 24 may be between approximately 25% to approximately 75% of the length of a shaft portion 20.

In one embodiment, the handle upper portion (i.e., the portion of the handle 16 including the top six inches of each shaft 20, the vertical members 22 and the horizontal member 24) is formed (e.g., bent) into shape from a single piece of tubular metal to be a single integral or unitary piece. The overall handle 16 is then formed by the remaining portions of the shafts 20 being joined to the top six inches of the shafts 20 that are part of the handle upper portion.

In one embodiment, the vertical grips 22 and/or the horizontal grips 24 may include a gripping coating or jacket. Examples of gripping coatings or jackets include polymer or rubber sheaths, grit impregnated coatings, etc.

Pivotable Bracket

Figure 5:
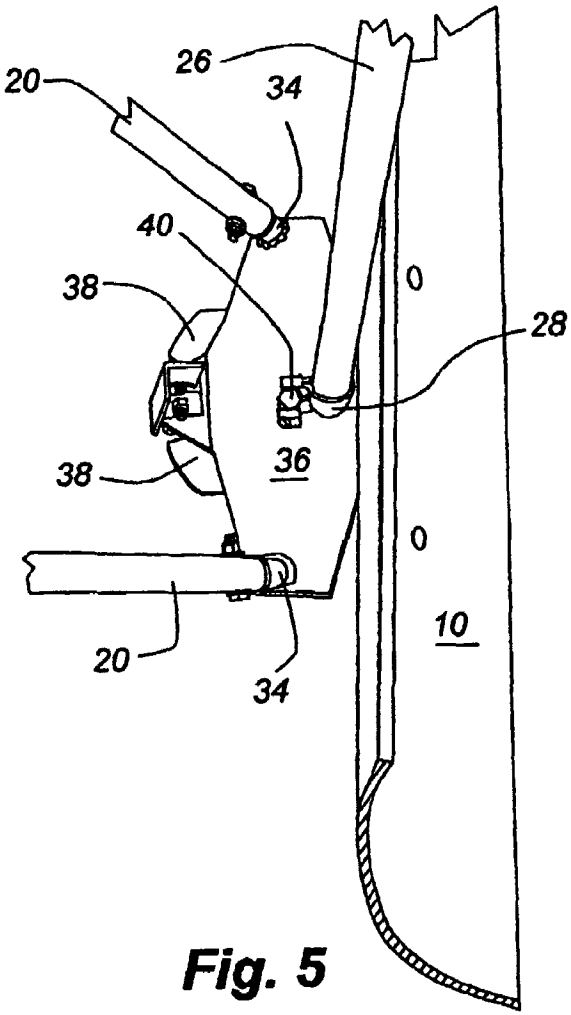
FIG. 5 is a perspective view of the pivotable bracket of the shovel of FIG. 1.
Figure 4:
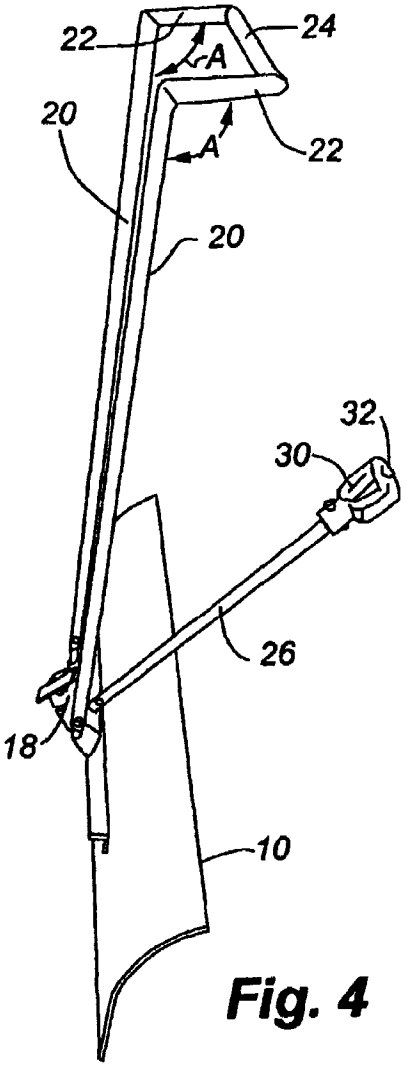
FIG. 4 is another side view of the shovel of FIG. 1.
Figure 13:
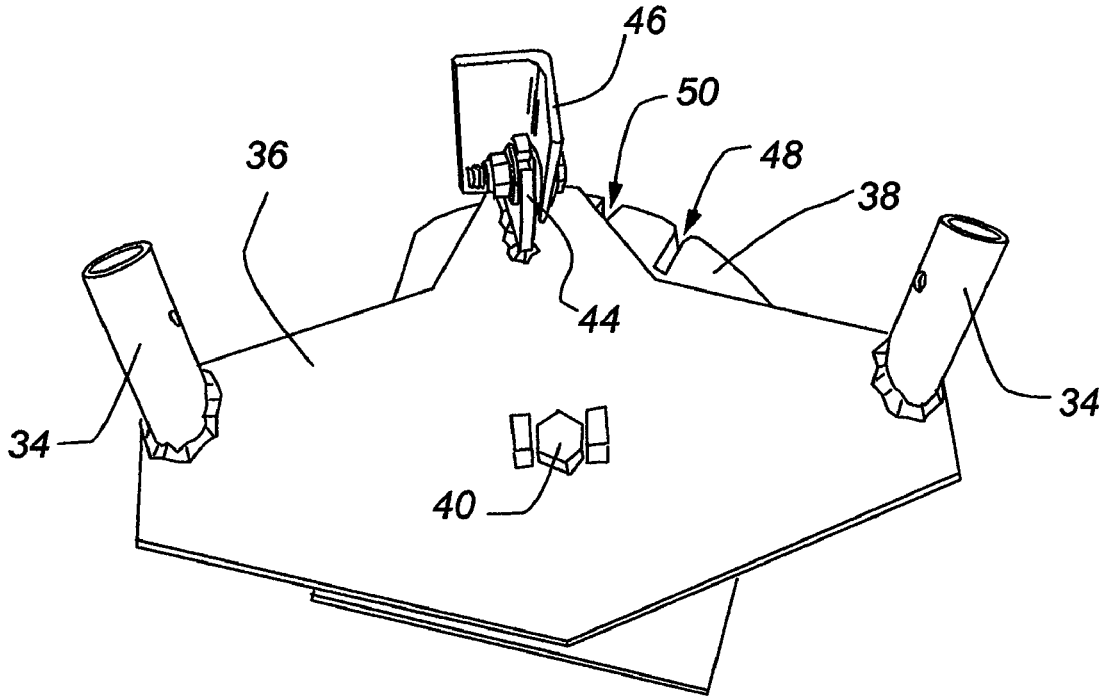
FIG. 13 is a perspective view of the pivotable bracket of FIG. 8, shown in an angled position.
Figure 14:
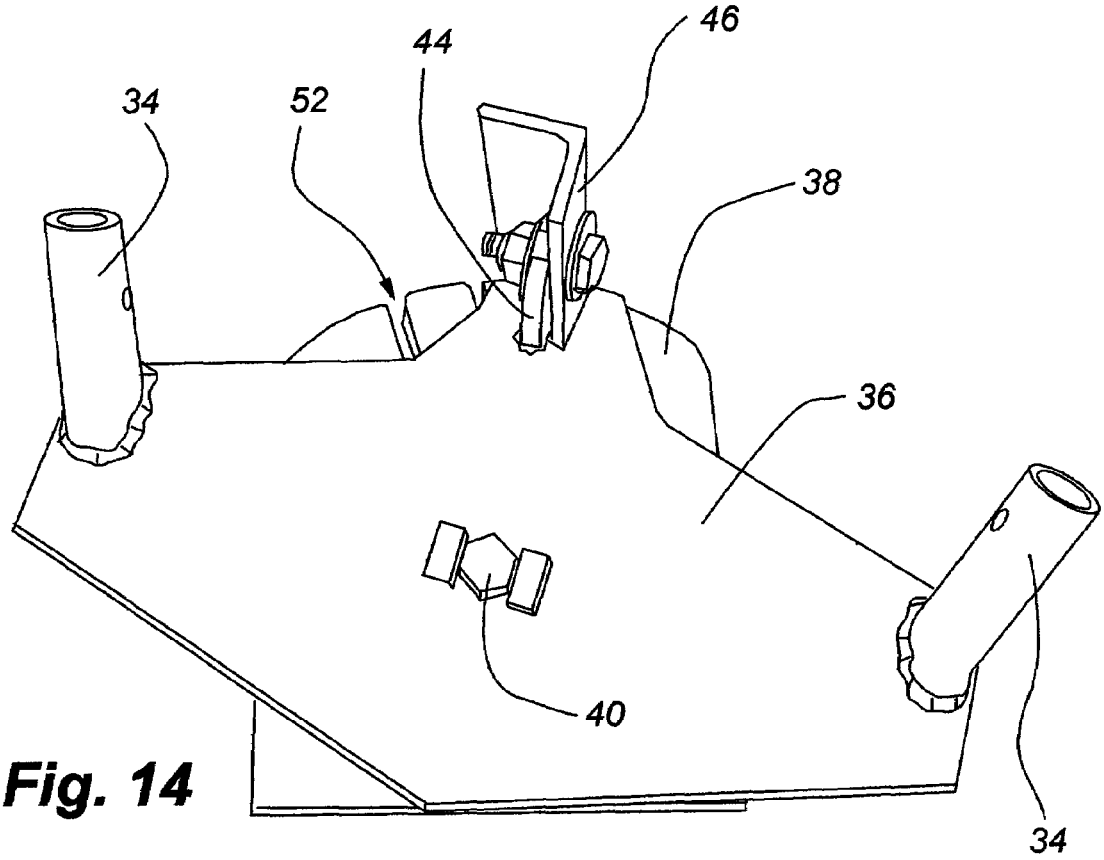
FIG. 14 is a perspective view of the pivotable bracket of FIG. 8, shown in an angled position.

As described above, bracket 18 is mounted to the rear surface 14 and secures handle 16 thereto. Specifically, shaft members 20 are inserted into sleeves 34 of bracket 18, which receives the lower ends of shaft members 20, and bolted thereto. The sleeves 34 are welded, or otherwise fixedly coupled by known means, to a pivot plate 36 of bracket 18, as seen in FIG. 5. Pivot plate 36 is a substantially planar surface and is pivotally attached to brace plate 38, which is also a substantially planar surface. Pivot plate 36 is pivotally coupled to brace plate 38 by pivot bolt 40, such that in an unlocked position, pivot plate 36 may rotate planarly with respect to brace plate 38. Angle X in pivot plate 36, shown in FIG. 7, permits the pivot plate 36 to pivot left or right without encountering blade 10. The pivot plate 36 is thereby configurable in an angled position, as described in more detail below and as shown in FIGS. 13 and 14, without being obstructed by convex rear surface 14. Brace plate 38 is fixedly attached to blade 10 by bracket mount 42 of bracket 18. Bracket mount 42 is bolted to blade 10, or otherwise fixedly mounted to blade 10 by known means, as shown in FIG. 2. Accordingly brace plate 38, which is fixedly attached to bracket mount 42, is fixed relative to blade 10 and does not move with respect to blade 10 during operation of the shovel.

Figure 6:
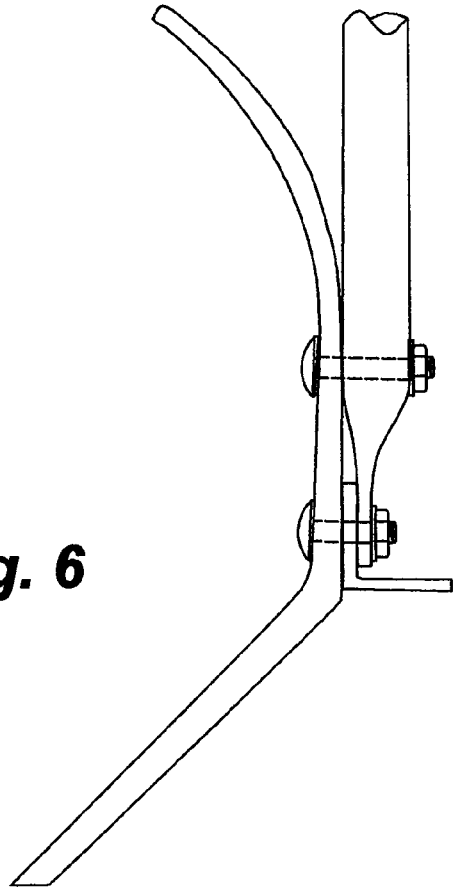
FIG. 6 is a side view of a blade and handle of a shovel in accordance with one embodiment of the present invention.
Figure 7:
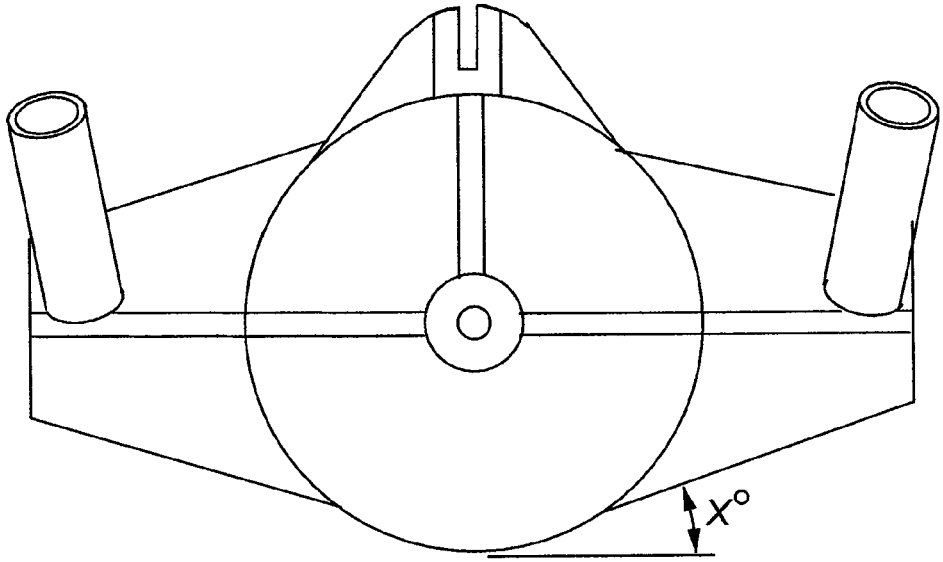
FIG. 7 is a top view and side view of a pivot bracket in accordance with one embodiment of the present invention.
Figure 8:
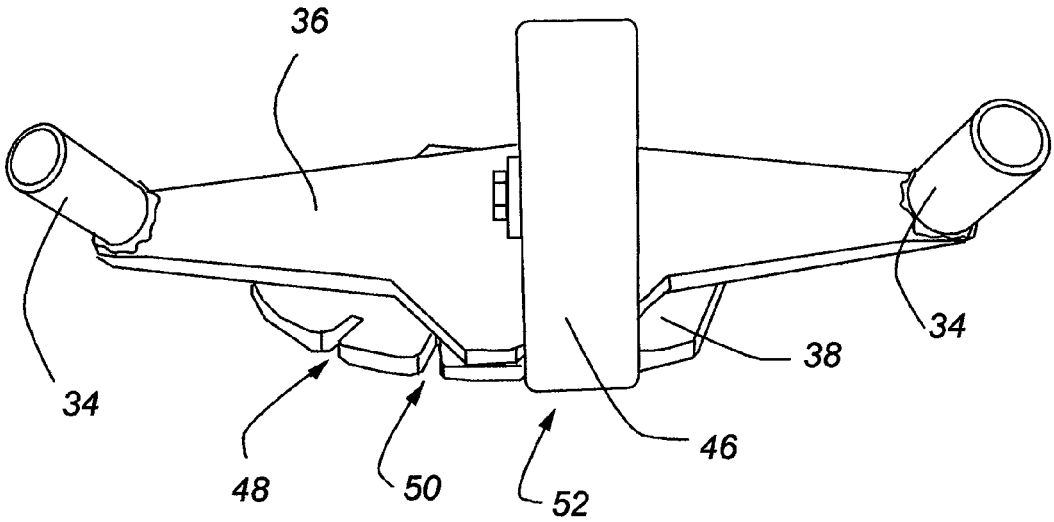
FIG. 8 is a perspective view of a pivotable bracket in accordance with one embodiment of the present invention, shown in a locked and angled position.
Figure 12:
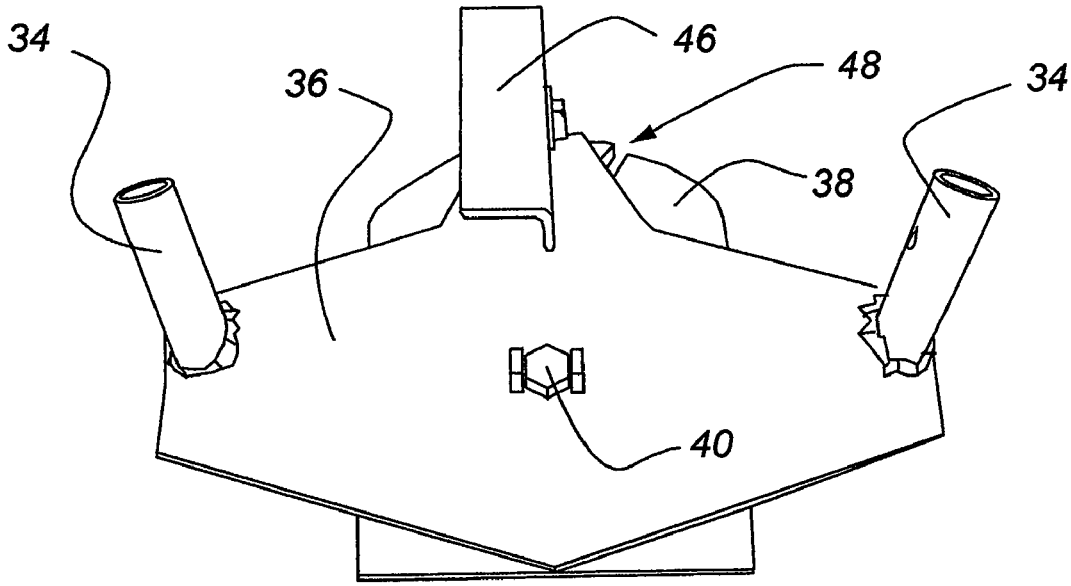
FIG. 12 is a perspective view of the pivotable bracket of FIG. 8, shown in a neutral position.

As pivot plate 36 rotates with respect to brace plate 38, crossbar grip handle 16, which is fixedly attached to pivot plate 36, also rotates relative to brace plate 38. As a result of the rotation, the angle between crossbar grip 24 and blade 10 is adjusted accordingly. For example, when pivot plate 36 is situated at a 17½° from brace plate 38 (FIG. 14), the angle between crossbar grip 24 and blade 10 is also 17½°. When pivot plate 36 is situated at a −17½° from brace plate 38 (FIG. 13), the angle between crossbar grip 24 and blade 10 is also −17½°. These angles are measured relative to the neutral configuration of pivot plate 36 and brace plate 38 (FIG. 12). The angles and other measurements of the shovel of one embodiment in accordance with the present invention are shown in FIGS. 6 and 7.

Figure 9:
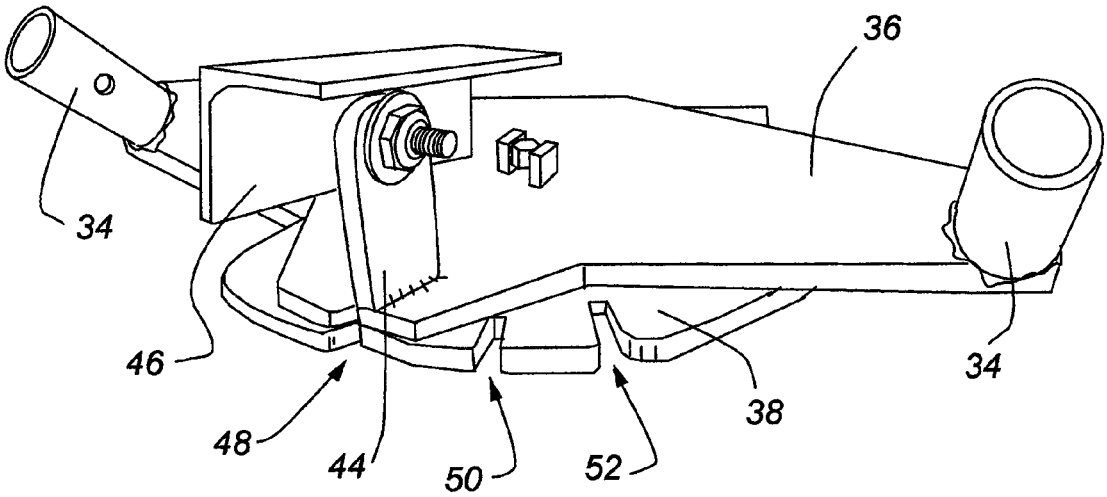
FIG. 9 is a perspective view of the pivotable bracket of FIG. 8, shown in an unlocked and angled position.
Figure 10:
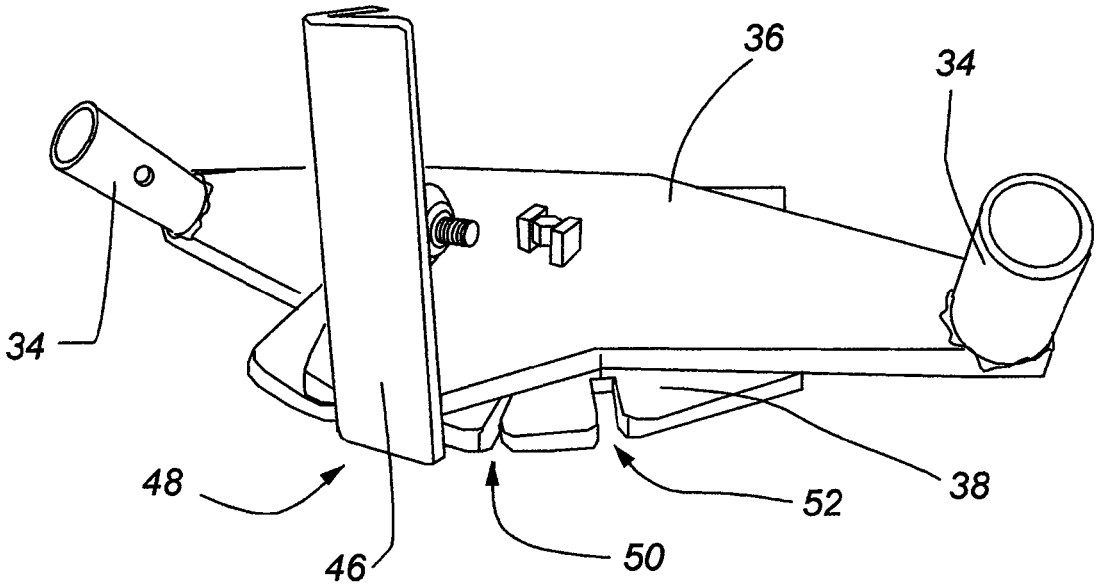
FIG. 10 is a perspective view of the pivotable bracket of FIG. 8, shown in a locked and angled position.
Figure 11:
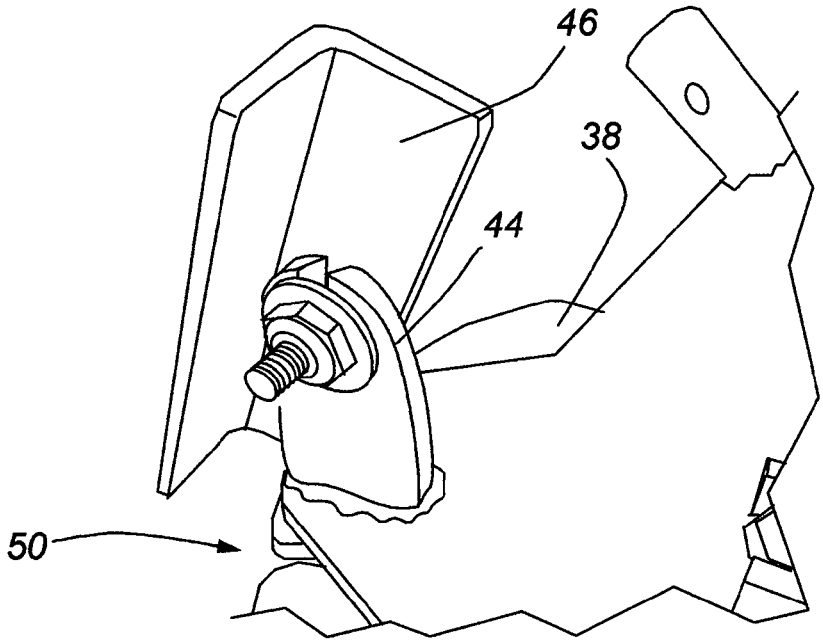
FIG. 11 is a perspective view of the pivotable bracket of FIG. 8, shown being locked.

With reference to FIGS. 8-14, an upright support member 44 is fixedly coupled to pivot plate 36 perpendicularly to the pivot plate. A rotatable locking member 46 is pivotably coupled to upright support member 44 with a nut and bolt or other known means. Locking member 46 may be situated in a locked position (FIG. 8) or an unlocked position (FIG. 9). FIG. 11 shows locking member 46 between the locked position and unlocked position, as is the case during locking or unlocking. In the locked position, a portion of locking member 44 fits into one of recesses 48, 50, and 52 formed in brace plate 38, thereby prohibiting pivot plate and crossbar grip handle 16 from rotating relative to brace plate 38 and blade 10. The nut and bolt that couple locking member 46 to upright support member 44 are sufficiently tightened to secure locking member into the locking position to ensure the locking member 46 does not move during operation of the shovel. In the unlocked position, locking member 46 is raised to be substantially parallel to pivot plate 36, thereby allowing pivot plate 36 to freely rotate relative to brace plate 38.

Locking pivot plate 36 into any of the three recesses 48, 50, and 52 provides distinct angles. Where locking member 46 is locked into recess 50 at a 0° angle (FIG. 12), the "neutral position," the crossbar grip handle 16 is fixed at a 0° angle to the blade 10. Pushing the shovel in this configuration provides for straightaway shoveling of snow or other or other materials. Where locking member 46 is locked into recess 52 at a −17½° angle (FIG. 13), the crossbar grip handle 16 is fixed at a −17½° angle to the blade 10, and where locking member 46 is locked into recess 48 at a 17½° angle (FIG. 14), the crossbar grip handle 16 is fixed at a 17½° angle to the blade 10. Pushing the shovel in either of these angled configurations provides for inclined shoveling of snow or other or other materials.

Figure 15:
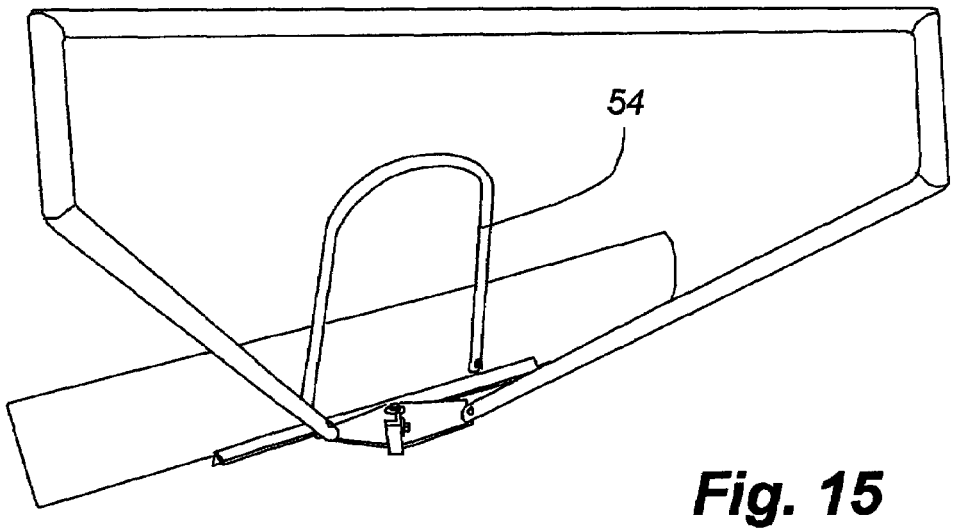
FIG. 15 is a perspective view of a shovel in accordance with one embodiment of the present invention.
Figure 16:
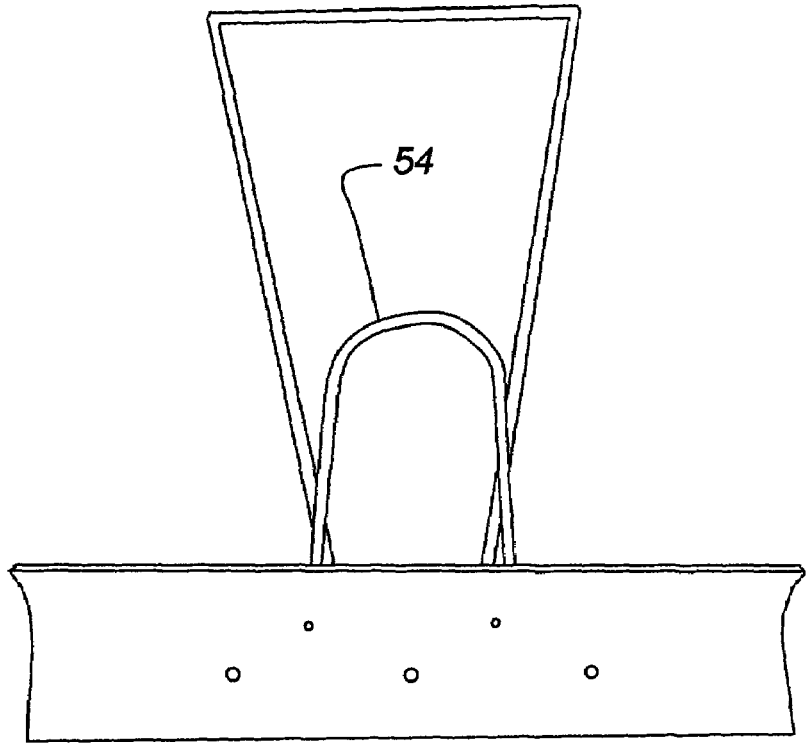
FIG. 16 is a front view of the shovel of FIG. 15.
Figure 17:
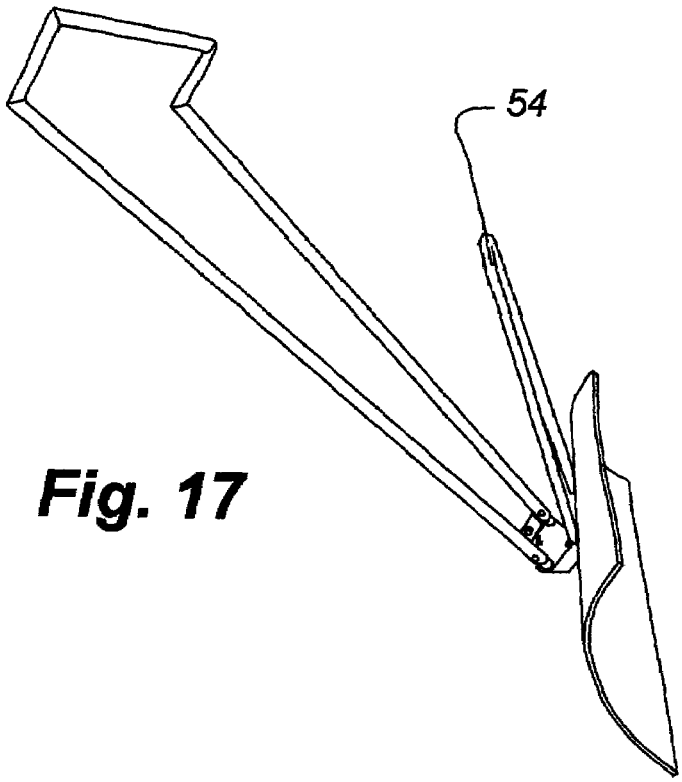
FIG. 17 is a side view of the shovel of FIG. 15.
Figure 18:
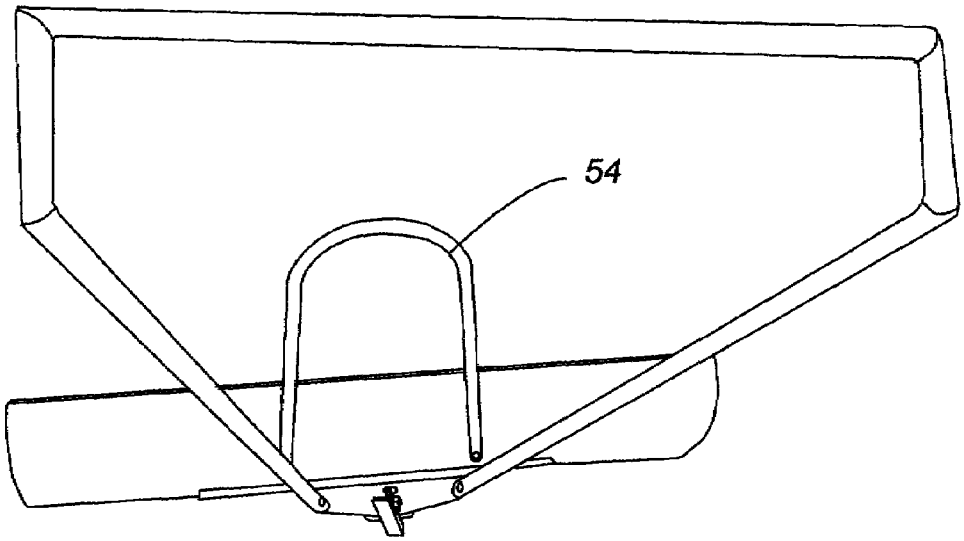
FIG. 18 is a rear view of the shovel of FIG. 15.

The angled configuration is shown in FIG. 15, where crossbar grip 24 is inclined relative to blade 10. In contrast, FIG. 16 shows crossbar grip 24 in the neutral position. When shoveling in an angled configuration, a user grips and exerts force on crossbar grip 24. Crossbar grip 24 may be substantially perpendicular to the direction of shoveling and the user may push crossbar grip 24 in a direction substantially parallel to the direction of shoveling. Because of the angled configuration, while crossbar grip 24 is perpendicular to the direction shoveling, blade 10 is at an angle (e.g., −17½° or 17½°) to the direction of shoveling. This arrangement advantageously causes the snow or other material being shoveled to travel along the blade 10 towards the declined end thereof. Accordingly, by pre-selecting which side of the shovel to angle the blade, a user determines to which side of the shovel the snow will be removed. Moreover, by removing the snow to a preselected side of the shovel, the user reduces the need to lift and throw the snow during shoveling; the snow naturally flows towards the selected side and reduces buildup in the front surface 12 of the blade 10.

While the capability of the blade 10 to pivot relative to the handle 16 offers many operational advantages, in some embodiments, the blade 10 will not be pivotally mounted relative to the handle 16. Instead, the blade 10 will be permanently fixed relative to the handle 16 at an angle as shown in FIG. 15 or in a neutral arrangement as shown in FIG. 16.

Second Handle

Again with reference to FIGS. 1-5, an embodiment of the shovel of the present invention further comprises a truncated shaft 26 that is inserted into a sleeve 28 of bracket 18, which receives the lower end of truncated shaft 26, and is bolted thereto. Handle 30 is mounted on the upper end of shaft 26 and may be a D-shaped handle with a handgrip 32. In one embodiment, sleeve 28 is pivotable such that truncated shaft 26 is permitted to pivot between an upright position, seen in FIG. 3, and a storage position where shaft 26 is substantially parallel to shaft members 20. Truncated shaft 26 is generally in the upright position during operation of the shovel and in the storage position when the shovel is stowed so as to reduce the space consumed by the shovel. Shaft 26 is lockable in both the upright position and storage position.

In operation, the user grips and exerts force on crossbar grip 24. When concave front surface 12 is filled with an amount of snow, or the force needed to continuing pushing the shovel otherwise becomes sufficiently substantial, that causes the user to remove the snow the user may grasp handgrip 32. By using handgrip 32, either alone or in conjunction with crossbar grip 24, the user may lift and pitch the amount of snow carried in concave front surface 12. Using handgrip 32 in conjunction with crossbar grip 24 permits the user move a load of snow by exerting a lifting force on handgrip 32 while stabilizing and leveraging crossbar grip 24 as a pivot point.

Figure 19:
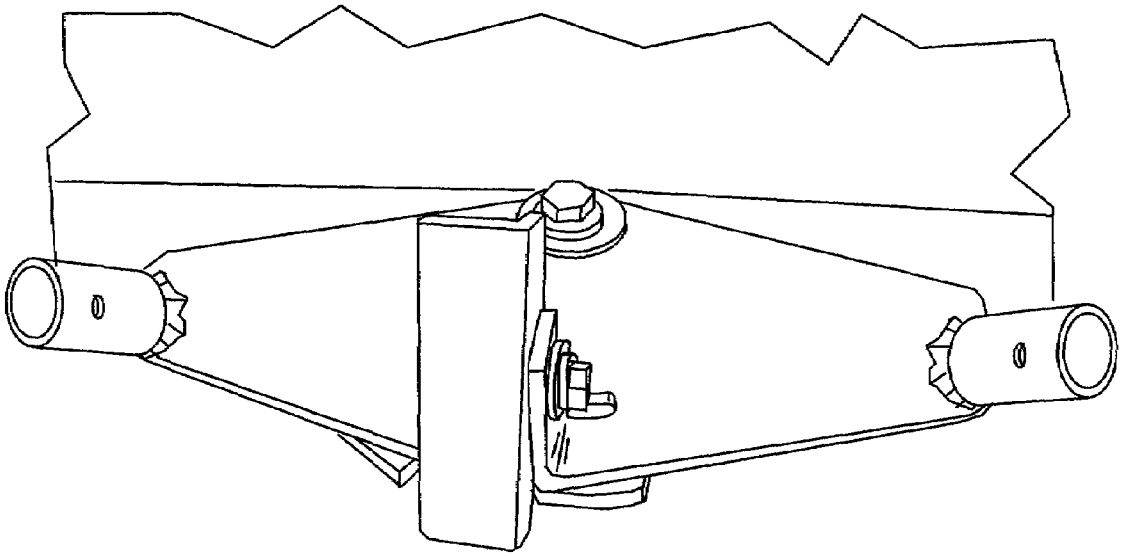
FIG. 19 is a perspective view of the pivotable bracket of the shovel of FIG. 15.

In another embodiment of the present invention, shown in FIGS. 15-19, a C-shaped handle 54 is provided. Handle 54 also allows the user a second gripping point with which to lift and pitch a load of snow carried concave front surface 12 while leveraging crossbar grip 24 as a pivot point. As shown in FIGS. 15-18, in this embodiment handle 54 is bolted into blade 10 at the two lower ends of handle 54, and the pivot plate therefore does not provide a sleeve for receiving handle 54, as seen in FIG. 19.

Depending on the embodiment, the second handle may be attached to the back of the shovel blade or, alternatively, to the pivot bracket or equivalent, where present.

Although the present invention has been described with reference to preferred embodiments, persons skilled in the art will recognize that changes may be made in form and detail without departing from the spirit and scope of the invention.

The invention claimed is:

1. A shovel for removing material from a surface, the shovel comprising:

a blade with a concave front side, a convex rear side, and an edge for contacting the surface, the front side and rear side defining a forward and rearward direction respectively;

a handle extending from the blade in a direction generally transverse to the edge of the blade; and a pivotable adjustable bracket connecting the handle to the blade;

wherein, the handle comprises:

a pair of shafts, each shaft having a first end, connected to the pivotable adjustable bracket, and a second end;

a pair of extension members each having a first end, connected to the second end of one of the pair of shafts, and a second end, each of the extension members having an orientation defining an angle between a respective extension member and shaft of between approximately 70 degrees and approximately 110 degrees; and a crossbar having a first end and a second end connected to respective second ends of the pair of extension members; and the pivotable adjustable bracket comprises:

a brace plate fixedly attached to the blade, the brace plate extending along the rear face of the blade transverse to the forward and rearward directions and further extending rearwardly from the blade;

a pivot plate positioned adjacent to and generally parallel to the brace plate, the pivot plate being pivotally coupled to the brace plate; and a locking member coupled to the pivot plate and adapted to selectively engage the brace plate and prevent the pivot plate from pivoting relative to the brace plate.

2. The shovel of claim 1, wherein the locking member is coupled to the pivot plate with a support member and the locking member is pivotally coupled to the support member.

3. The shovel of claim 2, wherein the brace plate is adapted to receive the locking member in a plurality of locations providing for a corresponding plurality of blade positions.

4. The shovel of claim 3, wherein the locking member has an angle shape.

5. The shovel of claim 3, wherein the plurality of locations includes a plurality of recesses in the brace plate.

6. The shovel of claim 5, further comprising a second handle extending from the blade.

7. The shovel of claim 1, wherein the brace plate includes a plurality of recesses for receiving the locking member.

8. The shovel of claim 7, wherein the plurality of recesses define a plurality of angular blade positions.

9. The shovel of claim 8, wherein the plurality of angular positions include −17½ degrees, 0 degrees, and 17½ degrees.

10. The shovel of claim 8, wherein the plurality of angular blade positions includes three angular blade positions.

11. The shovel of claim 10, wherein the three angular blade positions include −17½ degrees, 0 degrees, and 17½ degrees.

12. The shovel of claim 10, further comprising a second handle extending from the blade.

13. The shovel of claim 1, wherein the locking member has an angle shape.

14. The shovel of claim 1, wherein the pivot plate is pivotally coupled to the brace plate with a fastener.

15. The shovel of claim 1, further comprising a second handle extending from the blade.

16. The shovel of claim 1, wherein each extension member is substantially perpendicular to a respective one of the pair of shafts.

17. The shovel of claim 1, wherein each shaft of the pair of shafts is rigidly coupled to the pivot plate.

18. The shovel of claim 1, wherein the crossbar is between approximately 25% and 75% the length of the pair of shafts.

19. The shovel of claim 1, wherein the crossbar is between approximately 40% and 60% the length of the pair of shafts.

20. The shovel of claim 1, wherein each of the shafts of the pair of shafts diverge from the other such that the first ends are closer in proximity than the second ends.

* * * * *